United States Patent [19]

Scheurecker

[11] 4,106,549

[45] Aug. 15, 1978

[54] ARRANGEMENT FOR TRANSPORTING AWAY STRAND PIECES

[75] Inventor: Werner Scheurecker, Linz, Austria

[73] Assignee: Vereinigte Osterreichische Eisen-und Stahlwerke - Alpine Montan Aktiengesellschaft, Linz, Austria

[21] Appl. No.: 757,520

[22] Filed: Jan. 7, 1977

[30] Foreign Application Priority Data

Jan. 16, 1976 [AT] Austria ..... 267/76

[51] Int. Cl.[2] ..... B22D 11/12

[52] U.S. Cl. ..... 164/263; 164/441; 164/447; 83/157

[58] Field of Search ..... 164/282, 263, 447, 441; 83/109, 157

[56] References Cited

U.S. PATENT DOCUMENTS 1,150,541 8/1915 Ryan ..... 83/157

4,016,072 4/1977 Cavenor ..... 83/157 X

*Primary Examiner*—Robert L. Spicer, Jr.

*Attorney, Agent, or Firm*—Brumbaugh, Graves, Donohue & Raymond

[57] ABSTRACT

An arrangement for transporting away strand pieces, in particular crop ends cut off in continuous casting plants with a cutting means has a conveying roller path following the cutting device a cut strand discharge apparatus comprised of a plurality of arms pivotable over at least part of their length from a horizontal pick-up position into a tilted dropping position, and a lifting table carrying at least one conveying roller. The lifting table is perpendicularly displaceable relative to the conveying-roller-path plane. An inclined sliding path extending transversely to the strand guide is formed when the lifting table has been lowered and the arms are pressed into the tilted position by the weight of the cut off strand piece.

6 Claims, 2 Drawing Figures

ARRANGEMENT FOR TRANSPORTING AWAY STRAND PIECES

BACKGROUND OF THE INVENTION

The invention relates to an arrangement for transporting away strand pieces, in particular crop ends, cut off in continuous casting plants, having a conveying roller path arranged behind a cutting means, a cut strand discharge means and an inclined sliding path extending perpendicular to the strand guide.

Arrangements for transporting away billets or slab pieces cut off in continuous casting plants have already been known, wherein a pick-up table movable on wheels has been arranged below the cutting means. After cutting off the end piece, the so-called crop end, the latter falls upon the pick-up table, whereupon the pick-up table can be moved transversely to the conveying direction of the strand. After tilting of the pick-up table, the cut off piece slides into a scrap bucket. The known arrangement has the disadvantage that the pick-up table can easily be damaged by the cut off strand piece falling thereon. Furthermore, car-like transverse transporting means are necessary, which cause relatively high economic and structural expenditures. For moving away the crop ends of slabs these conveying means cannot be considered.

SUMMARY OF THE INVENTION

The invention aims at avoiding the above-described disadvantages and difficulties and has as its object to provide a simple arrangement for transporting away cut off strand pieces, such as crop ends, from continuous casting plants, which arrangement can easily be combined with a run-out roller table, does not require movable transporting means and is operationally safe.

This object is achieved in that the pick-up means is comprised of a plurality of arms which are tiltable from a horizontal pick-up position into a tilted dropping position over at least part of their length and that in the pick-up area at least one conveying roller is arranged on a lifting table that is displaceable perpendicularly to the plane of the roller path, after lowering the conveying roller, the pick-up arms are pressed into the tilted position by the weight of the cut off strand piece and it slides off.

Advantageously, the arms are designed to have two parts, wherein a horizontal part is rigidly secured to a stand or to the base and the other part is pivotable from the horizontal position into the dropping position.

Suitably, nose delimiting the sliding path of the cut off strand piece is provided on the lifting table.

Furthermore, a support is provided on the lifting table and the tiltable parts of the arms rest on the support.

According to an advantageous embodiment, a console limiting the tilting position of the arms is provided on the base and, when this console has been reached, the nose delimiting the sliding path becomes ineffective.

BRIEF DESCRIPTION OF THE DRAWINGS

The invention shall now be described by way of example only and with reference to the accompanying drawings, wherein.

DESCRIPTION OF AN EXEMPLARY EMBODIMENT

Figure 1:
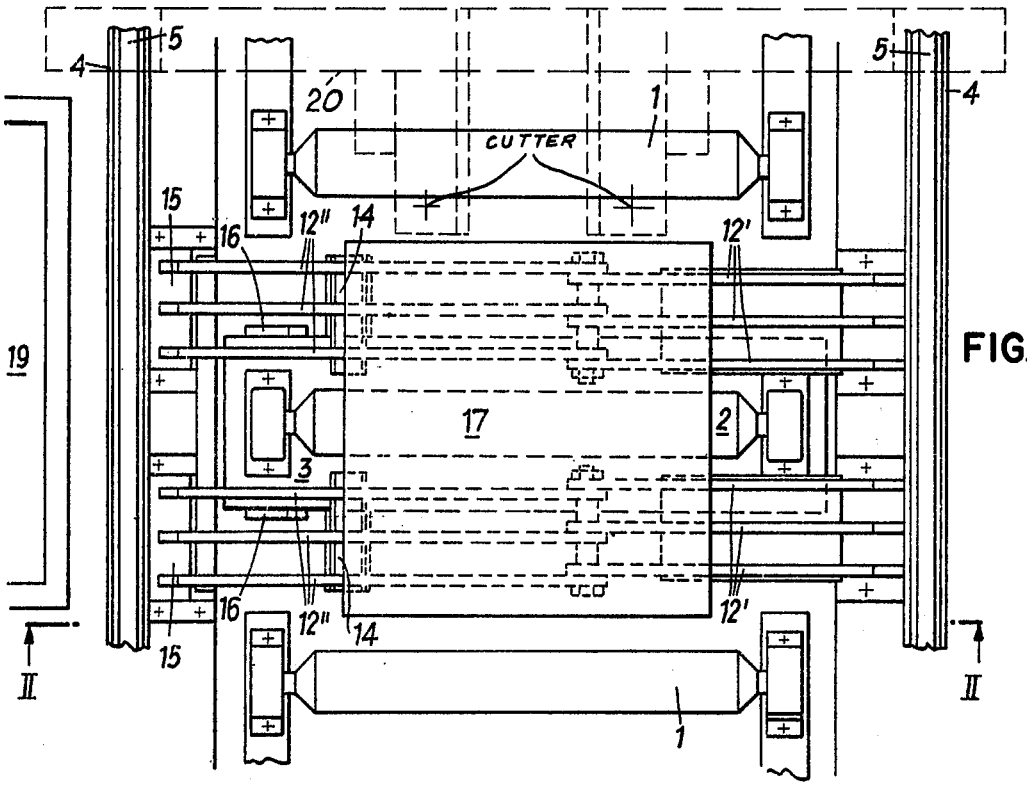
FIG. 1 is a ground plan of the arrangement according to the invention.

Between rollers 1 of a run-out roller table of a continuous casting plant, a roller 2 is arranged on a lifting table 3, which lifting table is movable in the vertical direction. Lateral of the run-out roller table, guide rails 5 are secured on carriers 4 arranged aproximately in the plane of the roller path formed by the rollers 1. The guide rails 5 are for the torch cutting means (20 shown in dotted line) with which the crop ends are separated from the cast strand.

The lifting table 3 is provided with a platform 6 carrying the roller 2, which platform is guided by guide rods 7 crossing each other and is lifted and lowered via levers 8 and 8'. The lever 8 is actuated by a pressure medium cylinder 9. A connecting rod 10 transmits the movement of the lever 8 to the lever 8' so that the platform 6 of the lifting table 3 always remains horizontally aligned. The lifting table is mounted on carriers 11 sunk into the base.

Figure 2:
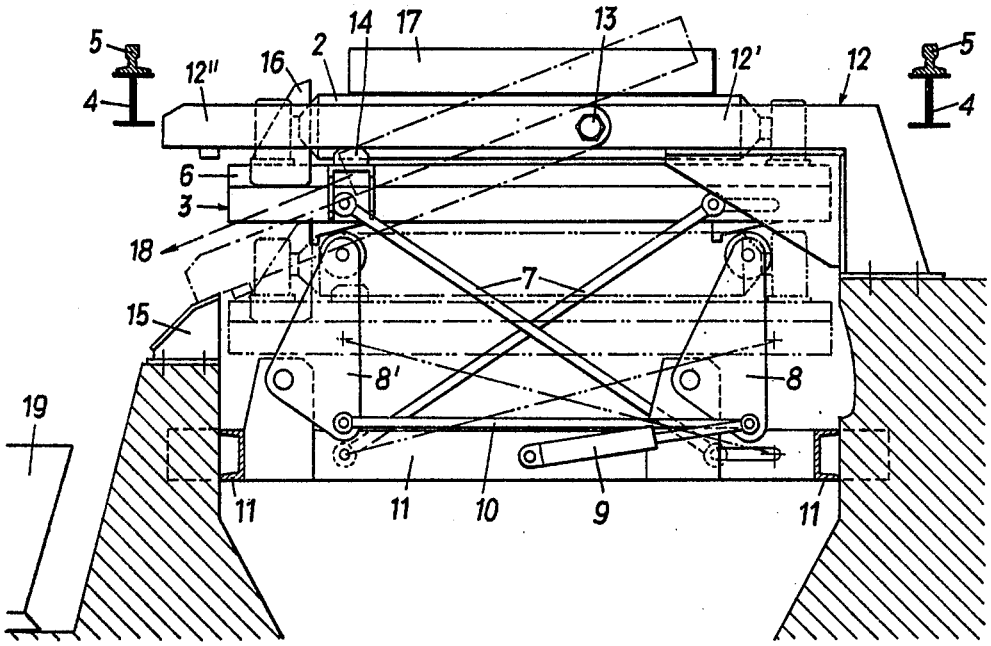
FIG. 2 illustrates a section along line II-II of FIG. 1.

At both sides of the roller 2 horizontal arms 12, whose upper edges lie below the plane of the roller path, extend transversely across the run-out roller table to form a cut strand discharge device. The arms 12 comprise two parts each. Part 12' of each arm is rigidly secured to the base and part 12'' of each arm is articulately secured by means of bolts 13 at the end of the rigid arm parts 12'. If the platform 6 is in an elevated position, the pivotable arm parts 12'' rest on supports 14 arranged lateral of the platform 6. This position is illustrated in full lines in FIG. 2. If the platform 6 is in a lowered position, which is entered in dot-and-dash lines in FIG. 2, the pivotable arm parts 12'' rest on consoles 15 secured to the base. At both sides of the roller 2, noses 16 protruding perpendicularly beyond the plane of the roller path are secured to the platform 6, the length of the noses being so dimensioned that they end below the upper edge of the arm parts 12'' when as the platform 6 has been lowered into its lowermost position and the pivotable arm parts 12'' rest on the consoles.

The arrangement works in the following manner: As soon as crop end 17 separated from the cast strand rests on the roller 2 mounted on the lifting table and is laterally supported against tilting off by the arms 12, the platform 6 is lowered. During the lowering the crop end is supported on the arm parts 12'' which are pivoting about the bolts 13, because of the weight of the crop end. The crop end is prevented from prematurely slipping off the platform by the noses 16. When the platform has reached its lowermost position, the sliding path formed by the arm parts 12'' is free and the crop end 17 slides off in the direction of the arrow 18 into the scrap container 19. During this transportation shocks created by the crop end 17 do not occur on the run-out roller table.

I claim:

1. In an arrangement for transporting away strand pieces, in particular crop ends, cut off in a continuous casting plant of the type including a base, a cutting means, a conveying path comprising a plurality of conveying rollers located after the cutting means in the travel direction of the strand pieces, a cut strand discharge means, and an inclined sliding path extending transversely to the conveying path, the improvement comprising:

a plurality of arms for the cut strand discharge means, said arms being pivotable over at least part of their longitudinal extension from a horizontal position downward into a tilted position; and a lifting table vertically displaceable perpendicular to the conveying path and located below the arms of the cut strand discharge means so as to partially support them, at least one of the conveying rollers being arranged on the lifting table, the cut strand discharge means and the lifting table being arranged relative to one another so that lowering of the lifting table causes the arms of the cut strand discharge means, over at least part of their longitudinal extension, to pivot downward into the tilted position due to the weight of a cut off strand piece so as to provide the inclined sliding path for the strand piece.

2. An arrangement as set forth in claim 1, wherein each one of the arms comprises a horizontally extending first part in rigid connection with the base and a second part that is pivotable from the horizontal position into the tilted position.

3. An arrangement as set forth in claim 2, wherein a stand is provided for rigidly connecting the first part of each arm with the base.

4. An arrangement as set forth in claim 1, further comprising at least one nose provided on the lifting table, which nose interrupts the sliding path.

5. An arrangement as set forth in claim 2, further comprising a support provided on the lifting table, the second part of each arm resting thereon when in the horizontal position.

6. An arrangement as set forth in claim 1, further comprising at least one nose provided on the lifting table to interrupt the sliding path, and a support member on the base to support the arms in the tilted position, the nose becoming ineffective when the arms are supported on the support member.

* * * * *